US011580943B2

(12) United States Patent
Yamada et al.

(10) Patent No.: US 11,580,943 B2
(45) Date of Patent: Feb. 14, 2023

(54) MUSICAL SOUND PROCESSING APPARATUS, MUSICAL SOUND PROCESSING METHOD, AND STORAGE MEDIUM

(71) Applicant: Roland Corporation, Shizuoka (JP)

(72) Inventors: Kenji Yamada, Shizuoka (JP); Yasuyuki Watanabe, Shizuoka (JP)

(73) Assignee: Roland Corporation, Shizuoka (JP)

( * ) Notice: Subject to any disclaimer, the term of this patent is extended or adjusted under 35 U.S.C. 154(b) by 262 days.

(21) Appl. No.: 17/001,690

(22) Filed: Aug. 25, 2020

(65) Prior Publication Data

US 2021/0065665 A1 Mar. 4, 2021

(30) Foreign Application Priority Data

Sep. 4, 2019 (JP) ..... JP2019-161612

(51) Int. Cl.
*G10H 1/00* (2006.01)
*G10H 1/28* (2006.01)
*G10H 1/40* (2006.01)

(52) U.S. Cl.
CPC ..... *G10H 1/0008* (2013.01); *G10H 1/28* (2013.01); *G10H 1/40* (2013.01);
(Continued)

(58) Field of Classification Search
CPC ..... G10H 1/0008; G10H 2210/341; G10H 2210/375; G10H 2210/571; G10H 1/40; G10H 1/28
(Continued)

(56) References Cited

U.S. PATENT DOCUMENTS 4,158,978 A * 6/1979 Hiyoshi ..... G10H 1/28 84/DIG. 12
4,217,804 A * 8/1980 Yamaga ..... G10H 1/28 84/DIG. 12
(Continued)

FOREIGN PATENT DOCUMENTS

EP 0981128 2/2000
EP 981128 A1 * 2/2000 ..... G10H 1/28
(Continued)

OTHER PUBLICATIONS

"Office Action of Europe Counterpart Application" dated Nov. 24, 2021, p. 1-p. 5.
(Continued)

*Primary Examiner* — Christina M Schreiber
(74) *Attorney, Agent, or Firm* — JCIPRNET

(57) ABSTRACT

A musical sound processing apparatus, a musical sound processing method, and a storage medium capable of generating musical sound full of interest are provided. The musical sound processing apparatus includes a first control unit configured to control a timing of sounding of a first tone in steps that come with an interval therebetween and a second control unit configured to control a timing of sounding of a second tone following or overlapping the first tone according to a first tempo, wherein the first control unit is configured to control the timing of sounding of the first tone according to the first tempo when timing information has not been acquired from outside and control the timing of sounding of the first tone according to a second tempo which is based on the timing information and different from the first tempo when the timing information has been acquired.

20 Claims, 7 Drawing Sheets

(52) U.S. Cl.
CPC . *G10H 2210/341* (2013.01); *G10H 2210/375* (2013.01); *G10H 2210/571* (2013.01)

(58) Field of Classification Search
USPC ..... 84/609
See application file for complete search history.

(56) References Cited

U.S. PATENT DOCUMENTS 4,267,762 A * 5/1981 Aoki ..... G10H 1/28 84/DIG. 12
4,282,788 A * 8/1981 Yamaga ..... G10H 1/40 84/DIG. 12
4,345,501 A * 8/1982 Nakada ..... G10H 1/40 84/DIG. 12
4,402,244 A * 9/1983 Nakada ..... G10H 1/36 84/478
4,881,440 A * 11/1989 Kakizaki ..... G10H 1/0041 984/304
5,403,966 A * 4/1995 Kawashima ..... G10H 1/0553 84/723
5,796,026 A * 8/1998 Tohgi ..... G10H 1/36 84/613
6,166,316 A * 12/2000 Takahashi ..... G10H 1/28 84/657
10,726,821 B2 * 7/2020 Kanada ..... G10H 1/36
2005/0016366 A1 * 1/2005 Ito ..... G10H 1/28 84/716
2008/0072744 A1 * 3/2008 Ito ..... G10H 1/28 84/638
2012/0011988 A1 * 1/2012 Hara ..... G10H 1/40 84/613
2021/0065665 A1 * 3/2021 Yamada ..... G10H 1/0008
2021/0407480 A1 * 12/2021 Sato ..... G10H 1/0008

FOREIGN PATENT DOCUMENTS

EP 2866223 B1 * 2/2017 ..... G10H 1/00
JP 2002123256 4/2002
JP 2002258847 9/2002
JP 2002258847 A * 9/2002
JP 2002258850 9/2002
JP 2009180891 8/2009
JP 2009180891 A * 8/2009

OTHER PUBLICATIONS

"Search Report of Europe Counterpart Application", dated Jan. 26, 2021, pp. 1-8.

* cited by examiner

MUSICAL SOUND PROCESSING APPARATUS, MUSICAL SOUND PROCESSING METHOD, AND STORAGE MEDIUM

CROSS-REFERENCE TO RELATED APPLICATION

This application claims the priority benefits of Japan Patent Application No. 2019-161612, filed on Sep. 4, 2019. The entirety of the above-mentioned patent application is hereby incorporated by reference herein and made a part of this specification.

BACKGROUND

Technical Field

The disclosure relates to a musical sound processing apparatus, a musical sound processing method, and a storage medium.

Description of Related Art

An electronic musical instrument that has a function of playing performance synchronized with an external synchronization signal and a function of controlling the pitch of a musical sound is known in the art. For example, the time interval of a timing clock input from outside is measured to determine an external tempo and the pitch change rate of a musical sound is changed according to the external tempo. Thus, the pitch change time of a musical sound to be generated is adapted to the external tempo and the musical sound is played using the pitch change time (for example, see Patent Document 1&&).

Patent Documents

[Patent Document 1] Japanese Laid-Open No. 2002-258850

The disclosure provides a musical sound processing apparatus, a musical sound processing method, and a storage medium capable of generating musical sounds full of interest.

SUMMARY

One embodiment of the disclosure is a musical sound processing apparatus. This musical sound processing apparatus includes a first control unit configured to control a timing of sounding of a first tone in steps that come with an interval therebetween, and a second control unit configured to control a timing of sounding of a second tone following or overlapping the first tone according to a first tempo, wherein the first control unit is configured to control the timing of sounding of the first tone according to the first tempo when timing information has not been acquired from outside and control the timing of sounding of the first tone according to a second tempo which is based on the timing information and different from the first tempo when the timing information has been acquired.

Other embodiments of the disclosure include a musical sound processing method, a program, a storage medium storing the program, or the like having the same features as the musical sound processing apparatus described above.

DESCRIPTION OF THE EMBODIMENTS

Figure 1:
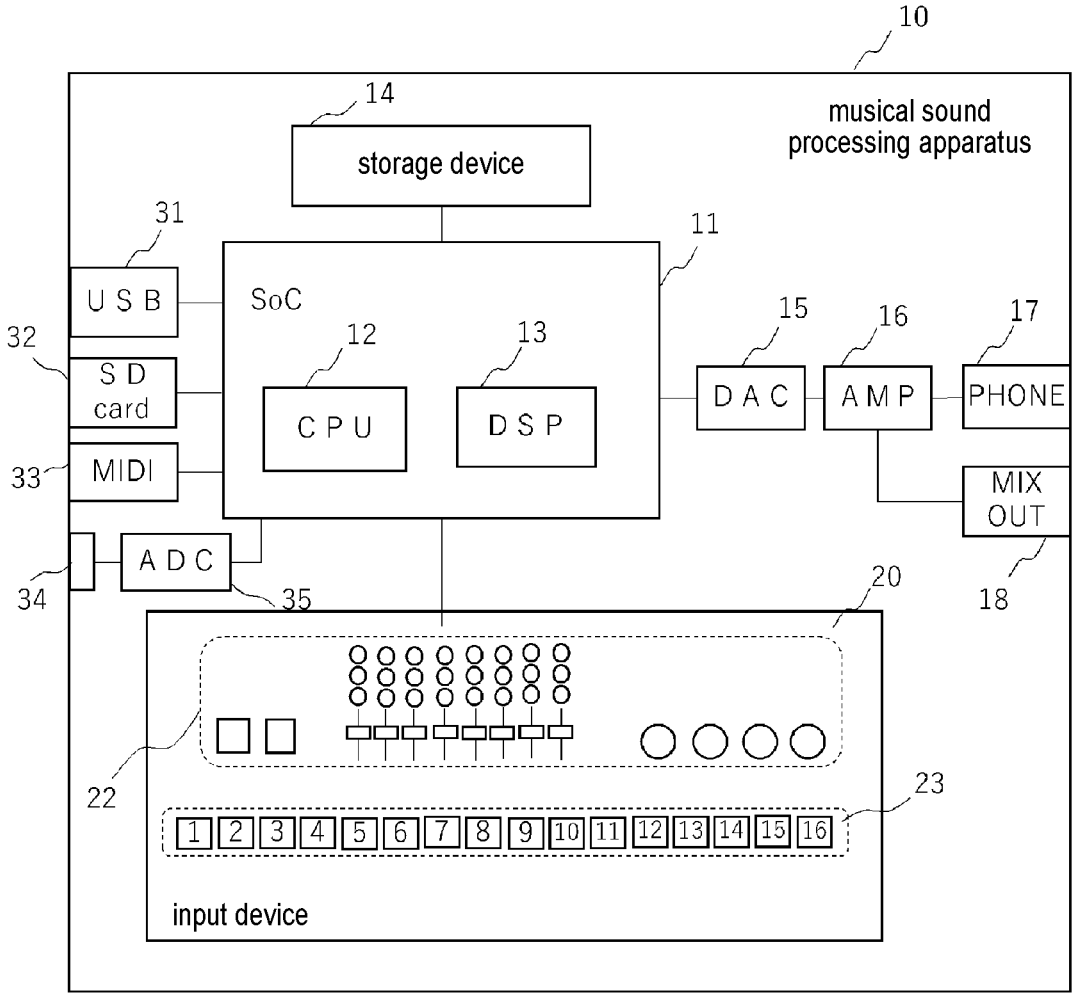
FIG. 1 shows an example of a circuit configuration of a musical sound processing apparatus according to an embodiment.

The musical sound processing apparatus according to an embodiment is configured as follows.

(1) The musical sound processing apparatus includes a first control unit configured to control a timing of sounding of a first tone in steps that come with an interval therebetween.

(2) The musical sound processing apparatus includes a second control unit configured to control a timing of sounding of a second tone following or overlapping the first tone according to a first tempo.

(3) The first control unit is configured to control the timing of sounding of the first tone according to the first tempo when timing information has not been acquired from outside and control the timing of sounding of the first tone according to a second tempo which is based on the timing information and different from the first tempo when the timing information has been acquired.

According to the musical sound processing apparatus, the first tempo or the second tempo can be selectively used as a tempo governing the timing of sounding of first tones according to the presence or absence of timing information. By sounding first tones according to the second tempo, it is possible to change the interval between first tones to be sounded in two adjacent steps. The interval between first tones increases when the second tempo is slower than the first tempo and decreases in the opposite case. The timings of sounding of second tones are according to the first tempo regardless of the presence or absence of timing information. Thus, the sounding interval of sets of first and second tones can be changed with the second tempo indicated by the timing information. This change can generate musical sounds full of interest.

Here, "from outside" mentioned above indicates acquisition from outside the musical sound processing apparatus. Acquisition from outside includes acquisition of timing information input from an external device (such as an external performance device) connected to an input terminal, acquisition of timing information read from a storage medium connected to or attached to the musical sound processing apparatus, and reception of timing information from a communication network through a network interface.

First tones that are output in steps may be the same or different tones. Second tones may be chord tones or non-harmonic tones as long as they are tones following or overlapping a first tone. However, the second tones are preferably one or two or more tones that form a chord together with the first tone. The second tones are preferably arpeggio performance tones that follow the first tone as a first chord tone. In other words, the second control unit preferably adopts a configuration for controlling the sounding of chord tones including the first tone.

The musical sound processing apparatus preferably further includes a sound source configured to output a third tone input from outside in parallel with the first and second tones at a timing of sounding according to the second tempo. The third tone is, for example, a rhythm tone. The rhythm tone preferably includes an accent tone that is generated periodically. However, the third tone may be other than a rhythm tone and may not include an accent tone.

The musical sound processing apparatus can adopt a configuration in which it further includes an operator configured to update one of the first tempo and the interval. By changing the first tempo or changing the interval between steps, it is possible to extend or contract the timing of sounding of tones which constitutes a set of the first and second tones (a chord). This extension or contraction changes the timing of sounding of each tone that matches the sounding of the third tone. That is, by changing the sounding-matching locations of tones that create a polyrhythm, it is possible to obtain musical sounds full of interest.

Hereinafter, a musical sound processing apparatus, a musical sound processing method, and a program according to an embodiment will be described with reference to the drawings. The configurations of the embodiment are examples and the disclosure is not limited to the configurations of the embodiment.

Configuration of Musical Sound Processing Apparatus

FIG. 1 shows an example of a configuration of a musical sound processing apparatus. The musical sound processing apparatus 10 includes a system on chip (SoC) 11 and a storage device 14 connected to the SoC 11. A universal serial bus (USB) connector 31, an SD card slot 32, and a connection terminal 33 for connecting to a musical instrument digital interface (MIDI) device are connected to the SoC 11. The SoC 11 is an example of a control device, a computer, or an information processing apparatus. The storage device 14 is an example of a storage unit and a storage medium.

The musical sound processing apparatus 10 (the SoC 11) is connected to a personal computer (PC) through the USB connector 31 to exchange USB MIDI and USB audio. The musical sound processing apparatus 10 can also display various setting information applied to the musical sound processing apparatus 10 using a display of the PC.

The SoC 11 reads and writes data such as musical sound data from and to the SD card connected to the SD card slot 32. The SoC 11 can also exchange MIDI data with a MIDI device connected thereto through the connection terminal 33.

Further, the musical sound processing apparatus 10 (the SoC 11) has an input terminal 34 for receiving a musical sound signal from an external performance device such as an electronic musical instrument. The input terminal 34 is connected to an analog to digital converter (ADC) 35 through which a digitized musical sound signal is input to the SoC 11.

The SoC 11 is an integrated circuit that operates as a central processing unit (CPU) 12, a digital signal processor (DSP) 13, and the like. The storage device 14 includes a read only memory (ROM) that stores programs executed by the CPU 12 and the DSP 13, a synchronous dynamic random access memory (SDRAM) used as a work area of the CPU 12, and the like.

The DSP 13 performs signal processing on a signal of musical sound data (a musical sound signal) input to the SoC 11 such as musical sound data (audio data) read from the SD card or musical sound data input from an electronic musical instrument such as a MIDI device. By executing a program, the CPU 12 performs control of exchange with a device (a PC or a display) connected through the USB connector 31, exchange with the SD card, or exchange with a MIDI device, control of the DSP 13, exchange with an input device 20, and so on.

A digital to analog converter (DAC) 15 is connected to the SoC 11 and an amplifier (AMP) 16 is connected to the DAC 15. The AMP 16 is connected to a headphone terminal (PHONE) 17 and a speaker terminal (MIX OUT) 18. The musical sound signal that has been subjected to signal processing of the DSP 13 is converted into an analog signal by the DAC 15, amplified by the AMP 16, and connected to headphones through the headphone terminal 17 or connected to a speaker through the speaker terminal 18. As a result, a musical sound corresponding to the musical sound signal is output through the headphones or speaker.

The musical sound processing apparatus 10 includes the input device (input panel) 20. The input device 20 includes operators 22 for setting various parameters relating to the musical sound processing apparatus 10. The operators 22 include a plurality of buttons, switches, sliders, knobs, dial knobs, and the like. The input device 20 also includes a button group 23 (buttons #0 to #15) of a predetermined number (16 in FIG. 1) used for setting a step sequencer.

Sequencer and Automatic Arpeggio Performance

Figure 2:
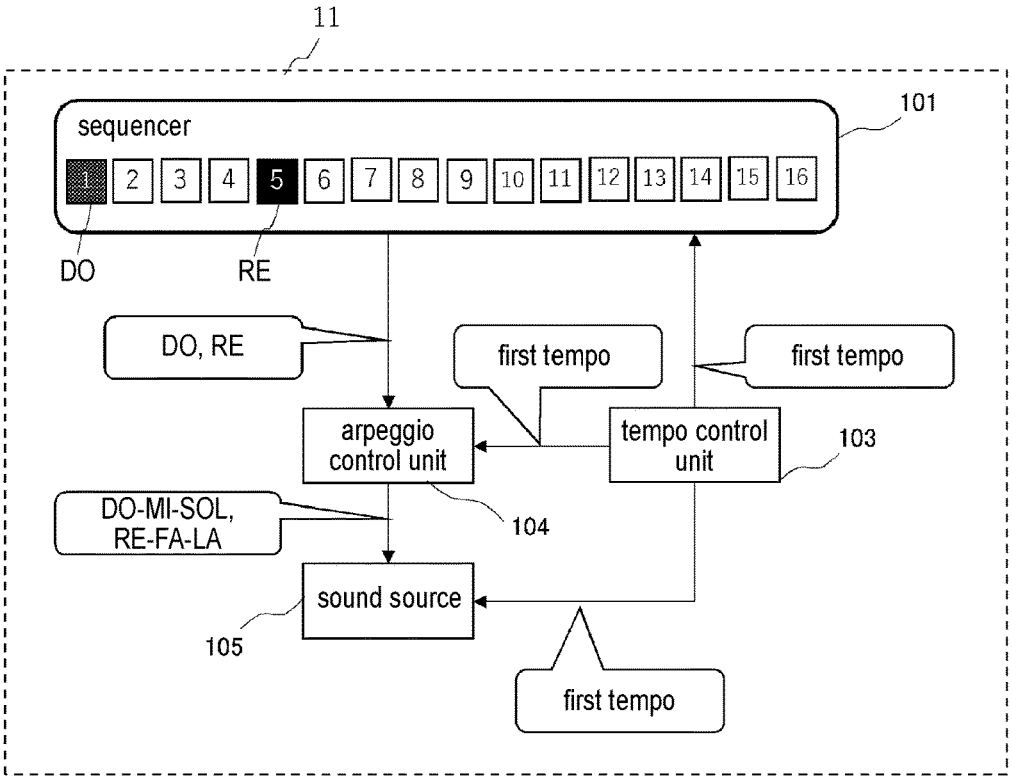
FIG. 2 is an explanatory diagram of a sequencer and automatic arpeggio performance.

FIG. 2 is an explanatory diagram of a sequencer and automatic arpeggio performance. The SoC 11 of the musical sound processing apparatus 10 operates as a sequencer 101 (a programming device for music production) through the operators 22 and the button group 23. For example, a user can set steps to be sounded from a maximum of 16 steps using the button group 23 (#1 to #16). At this time, the steps to be sounded can be determined with a predetermined step interval therebetween (an example of an interval).

For example, to sound steps 1 and 5 among 16 steps, the steps to be sounded can be selected by pressing the buttons #1 and #5. If the steps 1 and 5 are selected, the step interval therebetween is 4. The step interval "4" is an example and the step interval can be set to any number other than 4.

The user can also set music note information (also referred to as note data) for each of the selected steps using the operators 22. The music note information includes a note number (scale information), note on/off (key depression/key release), a gate time (a duration from note on to off), a velocity (sound intensity), and the like.

The sequencer 101 advances through the steps, for example, according to tempo information that is referred to by the sequencer 101. For example, the SoC 11 operates as a tempo control unit 103 to provide the sequencer 101 with information or a signal indicating a first tempo that is based on clock pulses generated using a crystal oscillator included in the SoC 11. The sequencer 101 moves through the steps according to the first tempo.

In an example shown in FIG. 2, the example that a number of the steps is set as 8 (1 to 8) and music note information is set for steps "1" and "5" is shown. Sounding of a scale "do (C)" is set for the step 1 and sounding of a scale "re (D)" is set for the step 5. The sequencer 101 outputs music note information for sounding the scale "do" at the timing of sounding of the step 1 according to the first tempo and outputs music note information for sounding the scale "re" at the timing of sounding of the step 5. The music note information is stored in the storage device 14.

The SoC 11 operates as an arpeggio control unit 104 that plays automatic arpeggio performance according to an input tone. That is, the arpeggio control unit 104 generates information of a broken chord (information on notes forming a chord) according to a scale indicated by music note information of the input tone from the sequencer 101 and outputs music note information of chord tones forming the broken chord according to the first tempo.

For example, if the scale of the input tone from the sequencer 101 is "do," the arpeggio control unit 104 generates music note information of a broken chord "do-mi-sol" with the input tone "do" as a tone to be played first and outputs music note information for playing automatic arpeggio performance by sounding of the chord tones one by one. If the scale of the input tone from the sequencer 101 is "re," the arpeggio control unit 104 generates and outputs music note information of a broken chord "re-fa-la" with the input tone "re" as a tone to be played first.

Therefore, the arpeggio control unit 104 outputs music note information of chord tones "mi (E)" and "sol (G)" which are arpeggio performance tones following the input tone "do" from the sequencer 101 following music note information of the chord tone "do" as shown in FIG. 2. Further, the arpeggio control unit 104 outputs music note information of chord tones "fa (F)" and "la (A)" which are arpeggio performance tones following the input tone "re" from the sequencer 101 following music note information of the chord tone "re". Here, the arpeggio control unit 104 outputs the music note information of each chord tone according to the first tempo provided from the tempo control unit 103.

A tone that the sequencer 101 outputs at each step is an example of a "first tone" and two or more chord tones ("mi, sol" following "do") that follow the tone output by the sequencer 101 (for example, "do") as a first chord tone are each an example of a "second tone." That is, chord tones that the arpeggio control unit 104 outputs as arpeggio performance tones following a chord tone output by the sequencer 101 are each an example of a "second tone." The sequencer 101 is an example of a "first control unit" and the arpeggio control unit 104 is an example of a "second control unit." Although the operations of the sequencer 101 and the arpeggio control unit 104 are performed by the same executing entity (the SoC 11) in the present embodiment, the operations of the sequencer 101 and the arpeggio control unit 104 may be performed by different executing entities (processors and memories or hardware). Some of the operations of the sequencer 101 and the arpeggio control unit 104 may be performed by other software or hardware.

The arpeggio control unit 104 is an example of an automatic performance control unit and tones that the arpeggio control unit 104 outputs as second tones through automatic performance may be tones forming a chord played using a performance method other than arpeggio. Second tones may be non-harmonic tones. Second tones are preferably output between tones output by the sequencer 101 (between "do" and "re" in FIG. 2). However, a second tone may overlap the next tone (for example, "re" of step 5 subsequent to "do" of step 1) or may be output later than the next tone.

The SoC 11 operates as a sound source 105 (a PCM sound source) and generates and outputs a musical sound signal based on the music note information of each chord tone input from the arpeggio control unit 104. The CPU 12 can operate as each of the sequencer 101, the tempo control unit 103, and the arpeggio control unit 104 by executing a program stored in the storage device 14. The DSP 13 can operate as the sound source 105. The operations of the SoC 11 may be performed through software operations using a processor such as a CPU and a memory storing a program or may be performed through a dedicated or general-purpose integrated circuit (hardware) such as an application specific integrated circuit (ASIC) or a field programmable gate array (FPGA).

Figure 3:
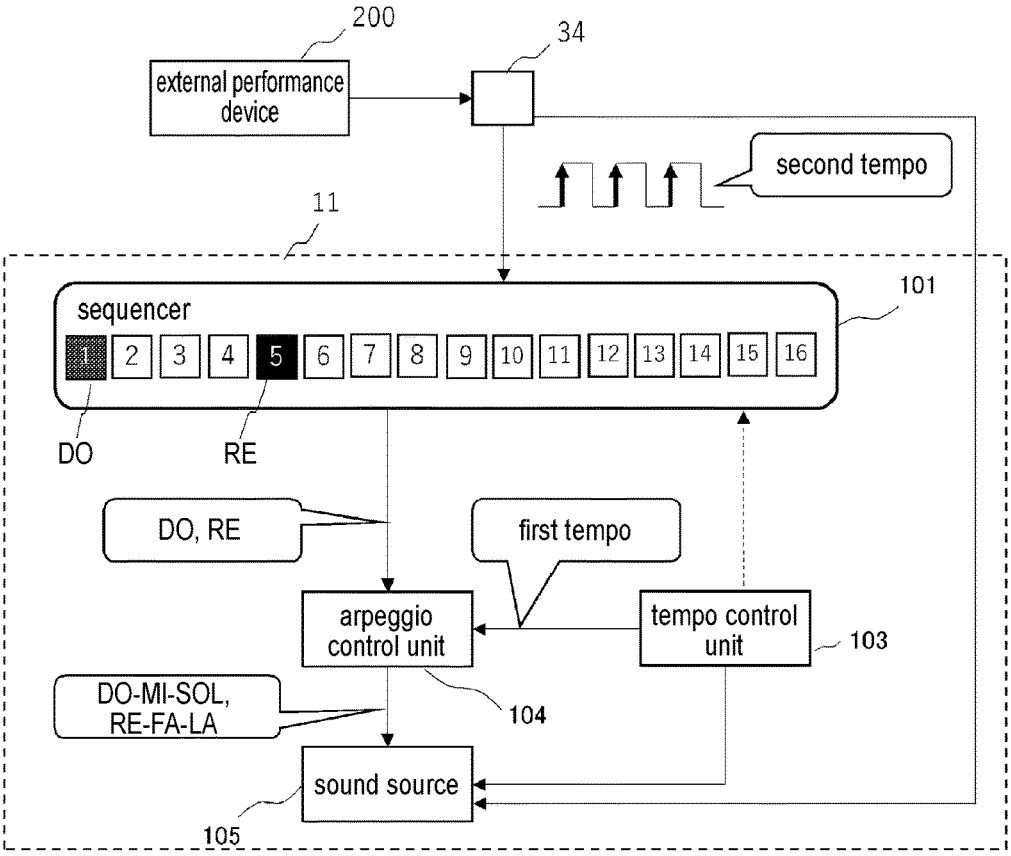
FIG. 3 shows the operation when timing information is input from outside.

FIG. 3 shows operations when there is an input from an external performance device 200 through the input terminal 34. As shown in FIG. 3, data indicating a second tempo (second timing information) is input from the external performance device 200 through the input terminal 34. The second timing information is, for example, information indicating an operation clock and the advance through steps (stepwise advance) is controlled such that the sequencer 101 advances one step at the rising edge of each clock pulse. The second tempo is preferably different than the first tempo.

Upon detecting the input of the second timing information, the sequencer 101 stops referring to the first timing information and controls the advance through steps according to the second tempo based on the second timing information. As a result, music note information of the tones "do" and "re" at the timings of sounding of steps 1 and 5 according to the second tempo is outputted. Thus, the interval between the tone "do" and the tone "re" increases when the second tempo is slower than the first tempo and decreases in the opposite case.

The arpeggio control unit 104 outputs the music note information of arpeggio performance tones corresponding to an input tone from the sequencer 101 at timings of sounding according to the first tempo as when there is no external input. Thus, when there is an external input, the start timings of playing the chord "do-mi-sol" and the chord "re-fa-la" are according to the second tempo, while the chord tones forming the chord "do-mi-sol" and the chord "re-fa-la" are each played according to the first tempo. In this way, it is possible to change the start timings of playing the chords of arpeggio performance tones according to information indicating the second tempo that is input through the input terminal 34.

Exemplary Process

Hereinafter, exemplary processes of the sequencer 101 and the arpeggio control unit 104 will be performed. The case where processes of the sequencer 101 and the arpeggio control unit 104 are each performed by the CPU 12 executing a program will be illustrated as an example.

Figure 4:
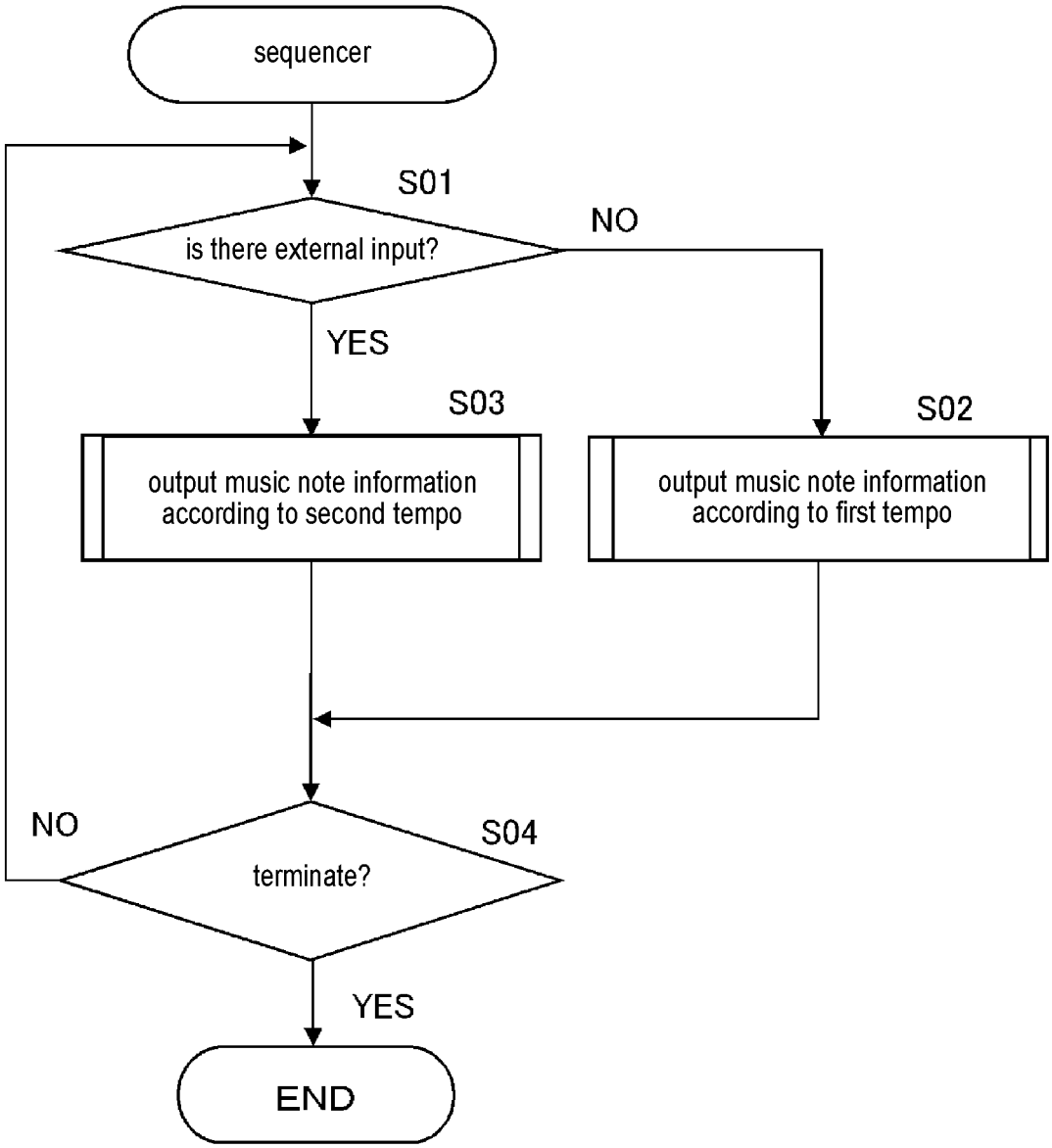
FIG. 4 is a flowchart showing an exemplary process of the sequencer.

FIG. 4 is a flowchart showing an exemplary process of the sequencer 101 (with the CPU 12 operating as the sequencer 101). In S01, the sequencer 101 determines whether or not there is an external input, that is, timing information indicating the second tempo has been input. Upon determining that the timing information has not been input (NO in S01), the sequencer 101 advances through the steps according to the first tempo and outputs corresponding music note information in steps for which note-on (sounding) is set (S02).

On the other hand, upon determining that the timing information has been input (YES in S01), the sequencer 101 advances through the steps according to the second tempo and outputs corresponding music note information in steps for which note-on (sounding) is set (S03). When the processing of S02 and S03 is completed, the process proceeds to S04 to determine whether or not the process of the sequencer 101 is to be terminated. When a termination condition such as power-off is satisfied, the sequencer 101 determines that the process is to be terminated and terminates the process of the sequencer 101. If it is determined that the process is not to be terminated (NO in S04), the process returns to S01.

Regarding the processing of S02 and S03, information indicating steps to be sounded set by the user and music note information of tones to be sounded are stored in the storage device 14 in advance. When a step to be sounded comes, the sequencer 101 reads music note information of a tone to be sounded in the step from the storage device 14. The read music note information is provided to the arpeggio control unit 104.

Figure 5:
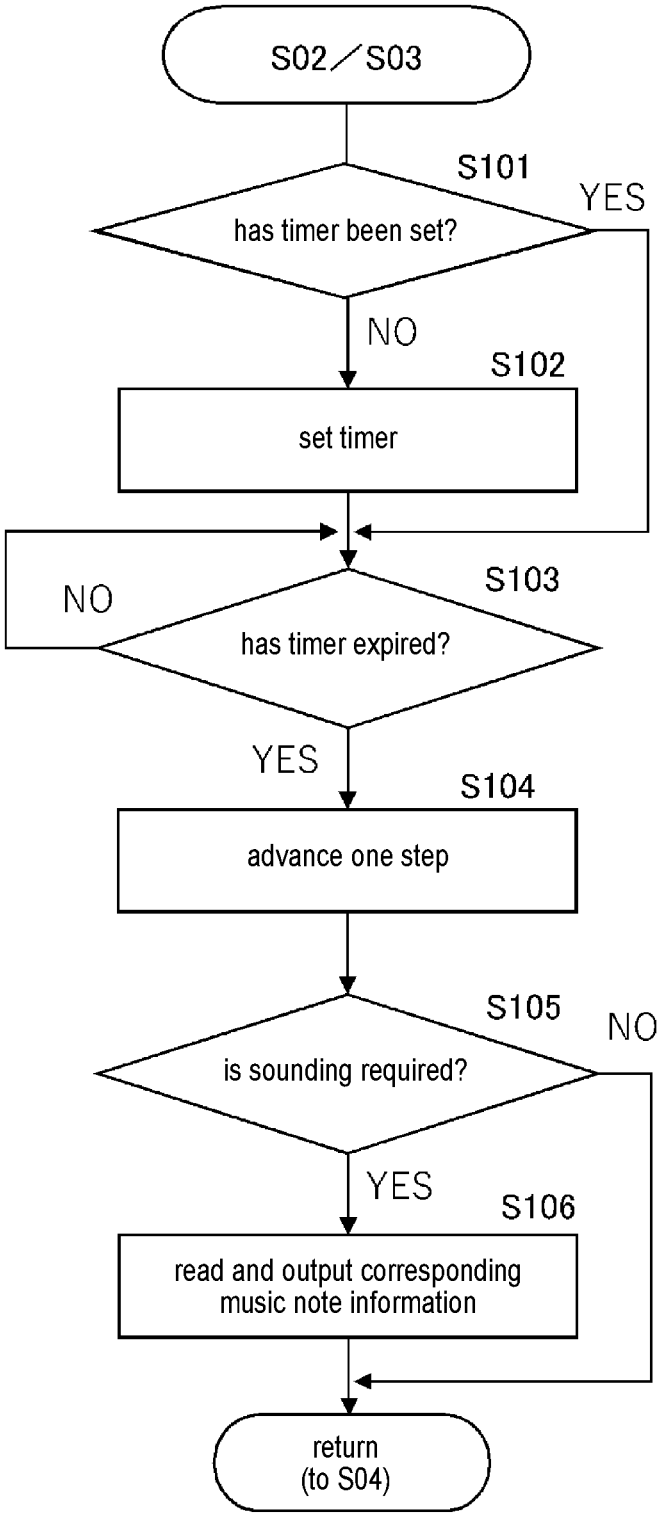
FIG. 5 is a flowchart showing an exemplary process of the sequencer.

FIG. 5 is a flowchart showing details of the processing of S02 and S03. In S101, the sequencer 101 determines whether or not a timer for measuring the timing of sounding has been set. When the timer has not been actually set or when the timer has been set and a flag indicating an external input has been set, the sequencer 101 determines that the timer has not been set. The process proceeds to S103 if it is determined that the timer has been set (YES in S101) and proceeds to S102 if not (NO in S101).

In S102, the sequencer 101 sets a timer (referred to as a first timer). When the processing of S102 is performed in S02, the sequencer 101 sets a unit time according to a first tempo that has been preset as a time to be measured by the timer. For example, if the first tempo is BPM=120, the sequencer 101 sets 0.5 (=120/60) seconds as a unit time to be measured by the timer. When the processing of S102 is performed in S03, the sequencer 101 sets a unit time according to the second tempo indicated by the timing information as a time to be measured by the timer. The timer is a loop timer and is automatically reset upon expiration and repeats measuring the unit time.

The process from S103 onward is common to S02 and S03. In S103, the sequencer 101 determines whether or not the timer set in S102 has expired. Upon determining that the timer has expired, the sequencer 101 advances one step (S104). In S105, the sequencer 101 refers to setting information (stored in the storage device 14) relating to the step to which it has advanced in S104 and determines whether or not sounding is required. If it is determined that sounding is not required (NO in S105), the process proceeds to S04 (FIG. 4). On the other hand, if it is determined that sounding is required (YES in S105), the sequencer 101 reads music note information corresponding to the current step from the storage device 14 and outputs the music note information (S106) and returns the process to S04. The music note information output in S106 is provided to the arpeggio control unit 104.

Figure 6:
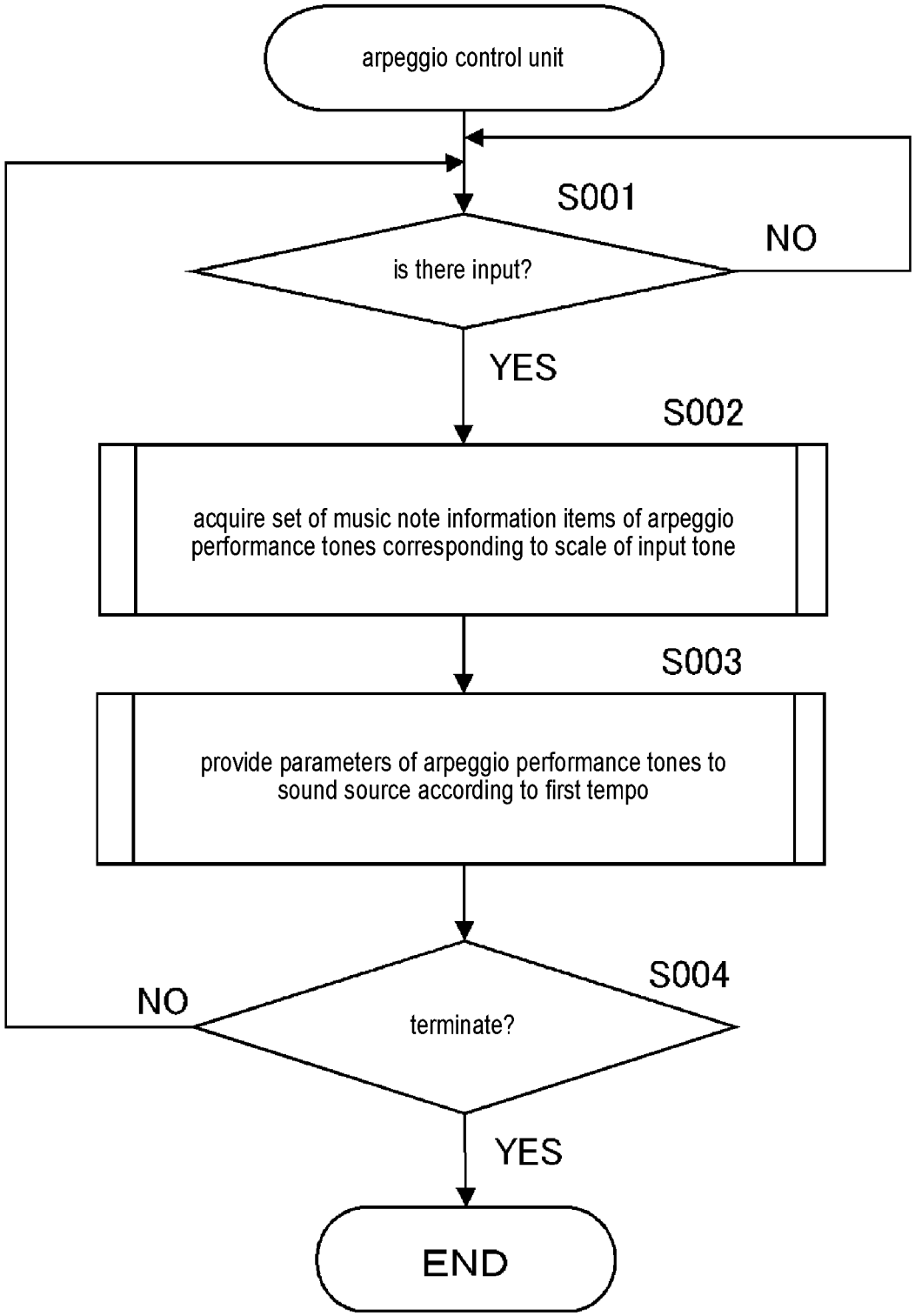
FIG. 6 is a flowchart showing an exemplary process of an arpeggio control unit.

FIG. 6 is a flowchart showing an exemplary process of the arpeggio control unit 104 (with the CPU 12 operating as the arpeggio control unit 104). In step S001, the arpeggio control unit 104 awaits input of music note information of the input tone (the first chord tone of arpeggio performance) from the sequencer 101. Upon determining that the music note information of the input tone has been input from the sequencer 101 (YES in S001), the arpeggio control unit 104 performs the following processing (S002).

Here, each set of music note information items for automatic arpeggio performance, that is, each set of music note information items for a plurality of chord tones (including a chord tone to be played first) that form a broken chord to be played in an arpeggio fashion is stored in the storage device 14 in advance. Each set of music note information items may be preset in the musical sound processing apparatus 10 or may be edited by the user and registered (stored) in the storage device 14. A plurality of sets of music note information items are prepared according to scales (which may also be pitches) and are associated with the scales of their first chord tones of arpeggio performance. In S002, the arpeggio control unit 104 identifies the scale of the input tone from the music note information of the input tone and reads a set of music note information items corresponding to the identified scale from the storage device 14.

Subsequently, the arpeggio control unit 104 provides parameters of the arpeggio performance tones to the sound source 105 according to the first tempo. That is, the arpeggio control unit 104 provides sounding parameters corresponding to music note information items included in the set of music note information items to the sound source 105 at timings of sounding according to the first tempo (S003). When the processing of S003 is completed, the process proceeds to S004 to determine whether or not the process of the arpeggio control unit 104 is to be terminated. When a termination condition such as power-off is satisfied, the arpeggio control unit 104 determines that the process is to be terminated and terminates the process of the arpeggio control unit 104. If it is determined that the process is not to be terminated (NO in S004), the process returns to S001.

Figure 7:
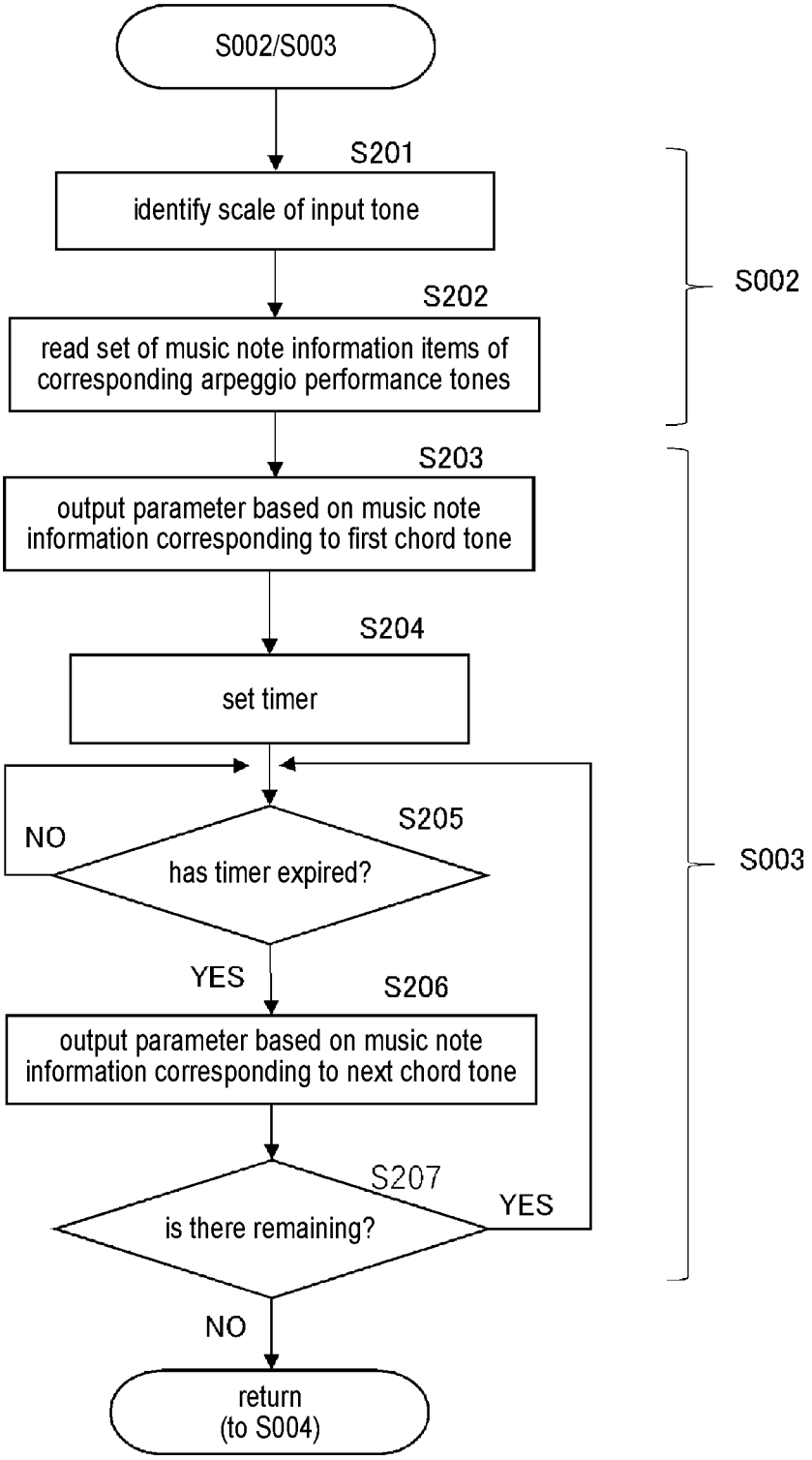
FIG. 7 is a flowchart showing an exemplary process of the arpeggio control unit.

FIG. 7 is a flowchart showing details of the processing of S002 and S003. The arpeggio control unit 104 identifies the scale of the input tone from the music note information of the input tone in S201 and reads a set of music note information items of arpeggio performance tones corresponding to the identified scale from the storage device 14 in S202.

In S203, the arpeggio control unit 104 outputs a sounding parameter based on music note information corresponding to a chord tone to be played first among a plurality of chord tones that are the arpeggio performance tones. The output sounding parameter is provided to the sound source 105.

In step S204, the arpeggio control unit 104 sets a timer (referred to as a second timer). A unit time according to a first tempo that has been preset is set as a unit time to be measured by the timer. The timer is a loop timer and repeats measuring of the unit time and notification of expiration.

In S205, the arpeggio control unit 104 awaits expiration of the timer. Upon detecting expiration of the timer (YES in S205), the arpeggio control unit 104 outputs a sounding parameter based on music note information corresponding to the next chord tone (S206).

In S207, the arpeggio control unit 104 determines whether or not there is a music note information item corresponding to a remaining chord tone in the set of music note information items. Here, if it is determined that there is a music note information item corresponding to a remaining chord tone (YES in S207), the process returns to S205. On the other hand, if it is determined that there is no music note information corresponding to a remaining chord tone, the process proceeds to S004.

The sound source 105 has an oscillator, a filter, an amplifier, and the like for sounding and performs a sounding process according to a sounding parameter based on music note information provided from the arpeggio control unit 104. The sounding process includes control of waveform generation, pitch, frequency domain, volume, envelope, or the like. The sound source 105 generates and outputs a musical sound signal according to the music note information through the sounding process. The musical sound signal is connected to the DAC 15 (FIG. 1) and finally a sound based on the musical sound signal is output to the outside.

Upon detecting an input tone, the arpeggio control unit 104 reads a corresponding set of music note information items and provides the sounding parameters without delay. The sound source 105 also performs a sounding process without delay in response to the provision of sounding parameters. Therefore, the tone which has been instructed to be sounded by the sequencer 101 (the input tone) is sounded according to the second tempo. On the other hand, the remaining chord tones following the input tone are sounded according to the first tempo under the timing control of the arpeggio control unit 104 described above.

Polyrhythm Structure

A musical sound signal (a third tone) having the second tempo, together with information indicating the second tempo, may be input through the input terminal 34 as shown in FIG. 3. The SoC 11 may treat this musical sound signal as a musical sound signal (a third musical tone) of a channel different from the channel of musical sound signals of automatic arpeggio performance (first and second tones) generated by the sequencer 101 and the arpeggio control unit 104 and the sound source 105 may output a musical sound in which the first and second tones and the third tone are mixed (the first and second tones and the third tone are sounded in parallel).

Figure 8:
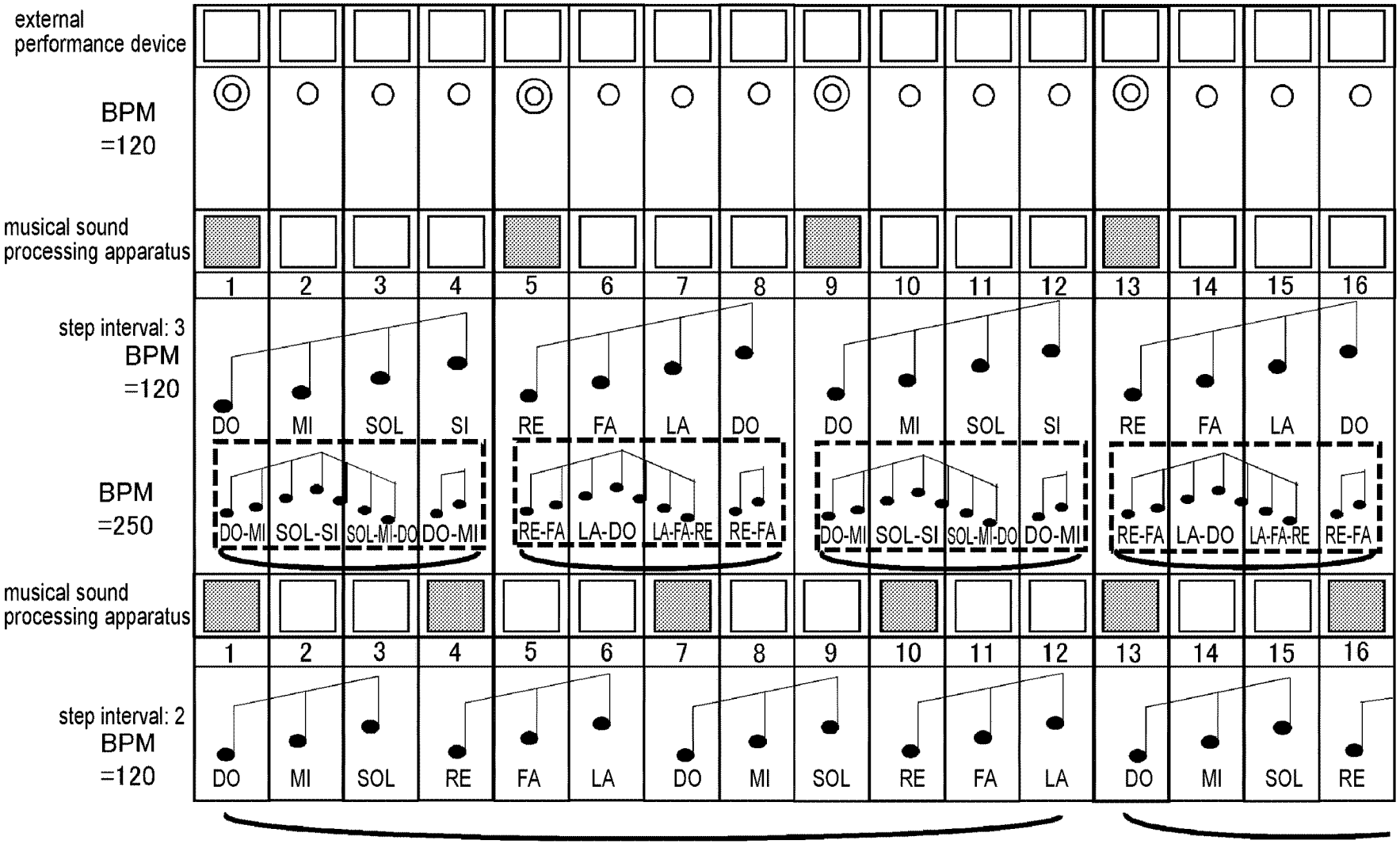
FIG. 8 is an explanatory diagram of first to third musical tones and their timings of sounding.

FIG. 8 is an explanatory diagram of the first to third tones and their timings of sounding. An upper row in FIG. 8 shows as an example of third tones from the external performance device 200 which are rhythm tones (drum tones) according to BPM=120 which is the second tempo (with one step sounded every four steps passed). Each rhythm tone is denoted by a normal circle or a double circle and the double circle indicates that it is an accent tone (with a higher velocity than that of tones denoted by normal circles). A third musical tone is sounded as one accent tone every four steps.

A middle row in FIG. 8 shows a state in which the step interval is 3, that is, performance (sounding) is set for steps 1, 5, and 9 among steps 1 to 16. Here, arpeggio performance tones (a dispersed chord) when BPM=120 is set as the first tempo (with one step sounded every four steps passed) are shown as examples of the first musical tones. The SoC 11 preferably performs synchronization control such that performance based on steps 1, 5, and 9 and performance of accent tones in the second musical tones are synchronized. However, synchronous control is not always necessary.

When the tempos of the first and second musical tones match (both BPM=120), the rhythm structure exhibits no particular musical characteristics. On the other hand, assume that the first tempo has been changed to BPM=250 (with the second tempo remaining at BPM=120) as shown in the middle part of FIG. 8. In this case, the first musical tones are arpeggio performance tones in which nine eighth notes are sounded every four steps passed. This creates a polyrhythm in which sounding of the first musical tones and the second musical tones match every measure. The change of the first tempo can be performed, for example, by operating the operators 22.

Further, assume that the first tempo is BPM=120 and the step interval is set to 2 as shown in a lower row of FIG. 8. In this case, the first musical tones are arpeggio performance tones in which three eighth notes are sounded every three steps passed, creating a polyrhythm in which sounding match every three measures.

It is possible to create a polyrhythm of second musical tones and obtain a musical sound which is characteristic (full of interest) by playing automatic arpeggio performance according to the first tempo different from the tempo of second musical tones (the second tempo) or by changing the step interval relating to the automatic arpeggio performance as described above. In the embodiment, arpeggio performance is illustrated as an example of automatic performance. However, performance other than arpeggio performance may also be performed. In this case, sounding parameters of tones following or overlapping a tone from the sequencer 101 are sent to the sound source 105 at appropriate timings. Components shown in the embodiment can be appropriately combined without departing from the purpose.

What is claimed is:

1. A musical sound processing apparatus comprising:

a first control unit comprising a sequencer configured to control a timing of sounding of a plurality of first tones where the control is performed in steps that come with an interval between the steps; and a second control unit configured to output a plurality of second tones having music note information corresponding to input tones from the first control unit and control a timing of sounding of the second tones following or overlapping the first tones according to a first tempo, wherein the first control unit is configured to control the timing of sounding of the first tones according to the first tempo when timing information has not been acquired from outside and control the timing of sounding of the first tones according to a second tempo which is based on the timing information and different from the first tempo when the timing information has been acquired from outside, which is outside musical sound processing apparatus.

2. The musical sound processing apparatus according to claim 1, wherein the second control unit is configured to control sounding of chord tones including the first tone.

3. The musical sound processing apparatus according to claim 2, wherein the chord tones including the first tone are arpeggio performance tones.

4. The musical sound processing apparatus according to claim 1, further comprising a sound source configured to output a third tone input from outside, which is outside musical sound processing apparatus, in parallel with the first tone and the second tone at a timing of sounding according to the second tempo.

5. The musical sound processing apparatus according to claim 4, wherein the third tone is a rhythm tone.

6. The musical sound processing apparatus according to claim 5, wherein the rhythm tone includes an accent tone that is generated periodically.

7. The musical sound processing apparatus according to claim 1, further comprising an operator configured to update one of the first tempo and the interval.

8. The musical sound processing apparatus according to claim 1, wherein the first control unit is configured to:

determine whether or not a timer configured to measure the timing of sounding of the first tones has been set;

determine whether or not the timer has expired upon determining that the timer has been set; and advance one step and refer to setting information of the step to determine whether or not sounding is required upon determining that the timer has expired.

9. The musical sound processing apparatus according to claim 1, wherein the second control unit is configured to, when an input tone is detected, read a corresponding set of music note information items and provide sounding parameters.

10. The musical sound processing apparatus according to claim 1, wherein the second control unit comprises an arpeggio control unit.

11. The musical sound processing apparatus according to claim 1, wherein the second control unit is configured to control the timing of sounding of the second tones following or overlapping the first tones according to the first tempo regardless of whether or not timing information has been acquired from outside, which is outside of the musical sound processing apparatus.

12. A musical sound processing method comprising:

a control device controlling a timing of sounding of a plurality of first tones where the control is performed in steps that come with an interval between the steps; and outputting a plurality of second tones having music note information corresponding to the first tones and controlling a timing of sounding of the second tones following or overlapping the first tones according to a first tempo, wherein in controlling the timing of sounding of the first tones, the timing of sounding of the first tones is controlled according to the first tempo when timing information has not been acquired from outside and the timing of sounding of the first tones is controlled according to a second tempo which is based on the timing information and different from the first tempo when the timing information has been acquired from outside, which is outside of the control device.

13. The musical sound processing method according to claim 12, wherein sounding of chord tones including the first tone is further controlled.

14. The musical sound processing method according to claim 12, wherein a third tone input from outside, which is outside of the control device is outputted in parallel with the first tone and the second tone at a timing of sounding according to the second tempo.

15. The musical sound processing method according to claim 12, wherein one of the first tempo and the interval is further updated.

16. The musical sound processing method according to claim 12, wherein:

whether or not a timer configured to measure the timing of sounding of the first tones has been set is determined;

whether or not the timer has expired upon determining that the timer has been set is determined; and whether or not sounding is required upon determining that the timer has expired is determined by advancing one step and referring to setting information of the step.

17. The musical sound processing method according to claim 12, wherein, when an input tone is detected, a corresponding set of music note information items is read and sounding parameters are provided.

18. The musical sound processing method according to claim 12, wherein controlling the timing of sounding of the second tones following or overlapping the first tones according to the first tempo is performed regardless of whether or not timing information has been acquired from outside, which is outside of the control device.

19. A storage medium storing a program causing a computer to execute a process of controlling a timing of sounding of a plurality of first tones where the control is performed in steps that come with an interval between the steps, a process of outputting a plurality of second tones having music note information corresponding to the first tones, a process of controlling sounding of chord tones includes the first tone and a process of controlling a timing of sounding of the second tones following or overlapping the first tones according to a first tempo, wherein in the process of controlling the timing of sounding of the first tones, the timing of sounding of the first tones is controlled according to the first tempo when timing information has not been acquired from outside and the timing of sounding of the first tones is controlled according to a second tempo which is based on the timing information and different from the first tempo when the timing information has been acquired from outside, which is outside of the computer.

20. The storage medium according to claim 19, wherein the process of controlling the timing of sounding of the second tones following or overlapping the first tones according to the first tempo is performed regardless of whether or not timing information has been acquired from outside, which is outside of the computer.

* * * * *